US008870612B2

(12) United States Patent
Onuma et al.

(10) Patent No.: US 8,870,612 B2
(45) **Date of Patent: *Oct. 28, 2014**

(54) CRIMPED TERMINAL

(75) Inventors: Masanori Onuma, Makinohara (JP); Kousuke Takemura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/813,488

(22) PCT Filed: Jul. 15, 2011

(86) PCT No.: PCT/JP2011/066189

§ 371 (c)(1),
(2), (4) Date: Jan. 31, 2013

(87) PCT Pub. No.: WO2012/017804

PCT Pub. Date: Feb. 9, 2012

(65) Prior Publication Data

US 2013/0130564 A1 May 23, 2013

(30) Foreign Application Priority Data

Aug. 5, 2010 (JP) ..... 2010-176039

(51) Int. Cl.
*H01R 4/10* (2006.01)
*H01R 4/28* (2006.01)
*H01R 4/18* (2006.01)

(52) U.S. Cl.
CPC *H01R 4/28* (2013.01); *H01R 4/185* (2013.01); *H01R 4/188* (2013.01)
USPC ..... 439/877

(58) Field of Classification Search
CPC ..... H01R 4/184; H01R 4/183; H01R 4/2495; H01R 4/26
USPC ..... 439/877, 882
See application file for complete search history.

(56) References Cited

U.S. PATENT DOCUMENTS

| | | | | |
|---|---|---|---|---|
| 5,316,506 | A | 5/1994 | Ito | |
| 5,370,560 | A | 12/1994 | Ito | |
| 8,177,591 | B2 * | 5/2012 | Okamura et al. | 439/877 |
| 2010/0087104 | A1 | 4/2010 | Gump et al. | |
| 2013/0130568 | A1 * | 5/2013 | Onuma et al. | 439/877 |

FOREIGN PATENT DOCUMENTS

| | | | |
|---|---|---|---|
| EP | 0 544 521 | A2 | 11/1992 |
| JP | 05-152011 | A | 6/1993 |
| JP | 2008-305571 | A | 12/2008 |
| JP | 2009-245695 | A | 10/2009 |
| JP | 2010-027463 | A | 2/2010 |
| JP | 2010027464 | A | 2/2010 |

OTHER PUBLICATIONS

International Search Report of PCT/JP2011/066189 dated Aug. 23, 2011.
European Search Report; Application No. 11814434.4-1801/2602874; PCT/JP2011066189; Feb. 7, 2014.

* cited by examiner

*Primary Examiner* — Phuong Dinh
(74) *Attorney, Agent, or Firm* — Sughrue Mion, PLLC

(57) ABSTRACT

A conductor crimp portion (11) before being crimped to a conductor (Wa) of an electric wire includes, in an inner surface (11R) of the conductor crimp portion (11), circular recesses (20) as serrations of the conductor crimp portion (11) scattered to be spaced from each other. At an inner periphery corner portion where an inner bottom surface (20A) and an inner periphery side surface (20B) of each of the recesses (20) intersect with each other, a roundness portion (20C) for connecting the inner bottom surface (20A) with the inner periphery side surface (20B) by a smooth continuous curved surface are provided.

1 Claim, 5 Drawing Sheets

(a)

(b)

CRIMPED TERMINAL

TECHNICAL FIELD

The present invention relates, for example, to an open barrel type crimp terminal used for an electric system of an automobile and having a conductor crimp portion having a U-shape cross section.

BACKGROUND ART

FIG. 1 is a perspective view showing a structure of an associated crimp terminal described, for example, in PTL 1.

A crimp terminal 101 has such a structure that, in the front portion in the longitudinal direction of a terminal (also the longitudinal direction of a conductor of an electric wire to be connected), there is provided an electrical connection portion 110 to be connected to a terminal of a mating connector side, behind the electrical connection portion 110, there is provided a conductor crimp portion 111 to be crimped to an exposed conductor of an end of an electric wire (not shown), and still behind the conductor crimp portion 111, there is provided a coated crimping portion 112 to be crimped to the electric wire's portion coated with an insulative coating. Between the electrical connection portion 110 and the conductor crimp portion 111, there is provided a first connecting portion 113 for connecting the electrical connection portion 110 with the conductor crimp portion 111. Between the conductor crimp portion 111 and the coated crimping portion 112, there is provided a second connecting portion 114 for connecting the conductor crimp portion 111 with the coated crimping portion 112.

The conductor crimp portion 111, which has a bottom plate 111A and a pair of conductor crimping pieces 111B, 111B provided to extend upwardly from right and left side edges of the bottom plate 111A and to be so crimped as to wrap the conductor of the electric wire positioned on an inner surface of the bottom plate 111A, is formed substantially into a U-shape in cross section. The coated crimping portion 112, which has a bottom plate 112A and a pair of coated crimping pieces 112B, 112B provided to extend upwardly from right and left side edges of the bottom plate 112A and to be so crimped as to wrap an electric wire (a portion with an insulative coating) positioned on an inner surface of the bottom plate 112A, is formed substantially into a U-shape in cross section.

The first connecting portion 113 on the front side of the conductor crimp portion 111 and the second connecting portion 114 on the rear side of the conductor crimp portion 111, which respectively have bottom plates 113A, 114A and low side plates 113B, 114B standing upwardly from right and left side edges of the bottom plates 113A, 114A, are each formed substantially into a U-shape in cross section.

A bottom plate in a range from a bottom plate (not shown) of the electrical connection portion 110 in the front portion to the coated crimping portion 112 in the rearmost portion (the bottom plate 113A of the first connecting portion 113, the bottom plate 111A of the conductor crimp portion 111, the bottom plate 114A of the second connecting portion 114, and the bottom plate 112A of the coated crimping portion 112) is formed continuously in a form of one piece of band plate. Further, the front and rear ends of the low side plate 113B of the first connecting portion 113 are continuous with respective lower half portions at a rear end of a side plate (no reference numeral) of the electrical connection portion 110 and at a front end of the conductor crimping piece 111B of the conductor crimp portion 111, while the front and rear ends of the low side plate 114B of the second connecting portion 114 are continuous with respective lower half portions at a rear end of the conductor crimping piece 111B of the conductor crimp portion 111 and at a front end of the coated crimping piece 112B of the coated crimping portion 112.

Of an inner surface 111R and an outer surface 1115 of the conductor crimp portion 111, the inner surface 111R on a side contacting the conductor of the electric wire is provided with a plurality of serrations 120 each in a form of a recess groove extending in a direction perpendicular to a direction in which the conductor of the electric wire extends (longitudinal direction of the terminal).

FIG. 2 is a detail view of the serrations 120 formed at the inner surface of the conductor crimp portion 111, where FIG. 2(*a*) is a plan view showing the developed conductor crimp portion 111 and FIG. 2(*b*) is a cross sectional view taken along the line IIb-IIb in FIG. 2(*a*), and FIG. 2(*c*) is an enlarged view of a portion IIc in FIG. 2(*b*).

The cross sectional configuration of the serration 120 in the form of the recess groove is either rectangular or inverted trapezoidal, where an inner bottom surface 120A is formed substantially parallel to an outer surface 1115 of the conductor crimp portion 111. An inner corner portion 120C where an inner periphery side surface 120B intersects with the inner bottom surface 120A is formed as an angular portion where a plane intersects with a plane. A hole edge 120D where the inner periphery side surface 120B intersects with the inner surface 111R of the conductor crimp portion 111 is formed as an angular edge.

For crimping, to the conductor of the end of the electric wire, the conductor crimp portion 111 of the crimp terminal 101, the crimp terminal 101 is placed on a placing surface (upper surface) of a not-shown lower mold (anvil), then the conductor of the end of the electric wire is inserted between the conductor crimping pieces 111A of the conductor crimp portion 111, and then the conductor of the end of the electric wire is placed on the upper surface of the bottom plate 111A. Then, lowering the upper mold (crimper) relative to the lower mold allows a guide inclined surface of the upper mold to gradually bring down a distal end side of the conductor crimping piece 111B inwardly.

Then, with the upper mold (crimper) further lowered relative to the lower mold, finally, the distal end of the conductor crimping piece 111B is so rounded, with a curved surface continuous from the guide inclined surface to a central mountainous portion of the upper mold, as to be folded back to the conductor side, and the distal ends of the conductor crimping pieces 111B being frictionally mated with each other are made to eat into the conductor, to thereby crimp the conductor crimping piece 111B in such a manner as to wrap the conductor.

The above operations can connect, by the crimping, the conductor crimp portion 111 of the crimp terminal 101 to the conductor of the electric wire. With respect to the coated crimping portion 112 as well, the lower mold and the upper mold are used to gradually bend the coated crimping pieces 112B inwardly, to thereby crimp the coated crimping pieces 112B to the electric wire's portion coated with the insulative coating. By these operations, the crimp terminal 101 can be electrically and mechanically connected to the electric wire.

In the crimp operation by the crimping, an applied pressure force allows the conductor of the electric wire to enter into the serration 120 at the inner surface of the conductor crimp portion 111 while causing a plastic deformation, thus strengthening the joint between the terminal 101 and the electric wire.

CITATION LIST

Patent Literature

Patent Literature 1: Japanese Unexamined Patent Publication No. 2009-245695 (FIG. 1)

SUMMARY OF INVENTION

Incidentally, with respect to the associated crimp terminal 101 set forth above, the inner surface 111R of the conductor crimp portion 111 is provided with the recess groove-shaped serrations 120 intersecting with the direction in which the electric wire extends. However, a sufficient contact conductivity was, as the case may be, not necessarily obtained. That is, when the conductor crimp portion 111 is crimped to the conductor of the electric wire, the surface of the conductor caused to flow by the pressing force causes a frictional mating with the hole edge of the serration or the surface of the conductor entering into the serration causes a frictional mating with the inner surface of the serration, thereby an oxide film of the surface of the conductor is peeled off and a newly formed surface exposed has a contact conduction with the terminal. In this respect, since being linear, the associated serration 120 showed an effectiveness when the conductor of the electric wire flows in the longitudinal direction. However, the associated serration 120 failed to show an effectiveness when the conductor extends in directions other than the longitudinal direction. Further, as shown in FIG. 5(*b*), an inner corner portion 120C where the inner bottom surface 120A and an inner periphery side surface 120B of the serration 120 intersect with each other is angular. Therefore, the conductor Wa having entered into the serration 120 fails to sufficiently reach as far as the inner corner portion 120C, thus causing a gap 150 to the inner corner portion 120C. Thus, there was such a fear as that, in the case of the large gap 150 caused, being influenced by thermal shock, mechanical vibration or the like, the oxide film grows with the gap 150 as a start point to thereby lower the contact conductivity between the conductor Wa and the terminal 101.

It is an object of the present invention to provide a crimp terminal capable of maintaining the contact conductivity between a conductor and the terminal continuously high.

An aspect of the present invention is a crimp terminal including: an electrical connection portion provided in a front portion in a longitudinal direction of the terminal; and a conductor crimp portion provided behind the electrical connection portion and crimped and connected to a conductor of an end of an electric wire, the conductor crimp portion having a cross section formed into a U-shape by a bottom plate and a pair of conductor crimping pieces provided to extend upwardly from both right and left side edges of the bottom plate and crimped to wrap the conductor disposed on an inner surface of the bottom plate, wherein the conductor crimp portion before being crimped to the conductor of the end of the electric wire includes, in an inner surface of the conductor crimp portion, circular recesses as serrations scattered to be spaced from each other, and wherein at an inner periphery corner portion where an inner bottom surface and an inner periphery side surface of each of the recesses intersect with each other, each of the recesses has a roundness portion for connecting the inner bottom surface with the inner periphery side surface by a smooth continuous curved surface.

The above aspect can bring about the following effects. That is, when the conductor crimp portion is crimped to the conductor of the electric wire by using the crimp terminal, the conductor of the electric wire, while causing a plastic deformation, enters into each of the small circular recesses provided, as serrations, at the inner surface of the conductor crimp portion, to thereby strengthen the joint between the terminal and the conductor. In this case, the surface of the conductor caused to flow by a pressing force has a frictional mating with the hole edge of each of the small circular recesses or the surface of the conductor entering into the recess causes a frictional mating with the inner periphery side surface of the recess, thereby an oxide film of the surface of the conductor is peeled off and a newly formed surface exposed has a contact conduction with the terminal. In this respect, since many small circular recesses are so provided as serrations, a total length of the hole edge of the recess brings about an effectiveness in scraping off the oxide film, irrespective of the extending direction of the conductor. Thus, the contact conduction effect by the exposure of the newly formed surface can be more increased than when the linear serration intersecting with the direction in which the conductor of the electric wire extends is provided like the associated example. Since the inner periphery corner portion where the inner bottom surface and inner periphery side surface of the small circular recess intersect with each other has the roundness portion in a form of a smooth curve, the conductor having entered into the recess is caused smoothly flow along the roundness portion, thus enabling to reduce the gap caused to the inner periphery corner portion. There was such a fear as that, in the case of a large gap, being influenced by thermal shock, mechanical vibration or the like, the oxide film grows with the gap as a start point to thereby lower the contact conductivity between the conductor and the crimp terminal. However, capability of reducing the gap can suppress the growth of the oxide film, thus enabling to maintain a good contact conduction performance for a long time.

DESCRIPTION OF EMBODIMENTS

Hereinafter, one embodiment of the present invention will be explained with reference to drawings.

Figure 1:
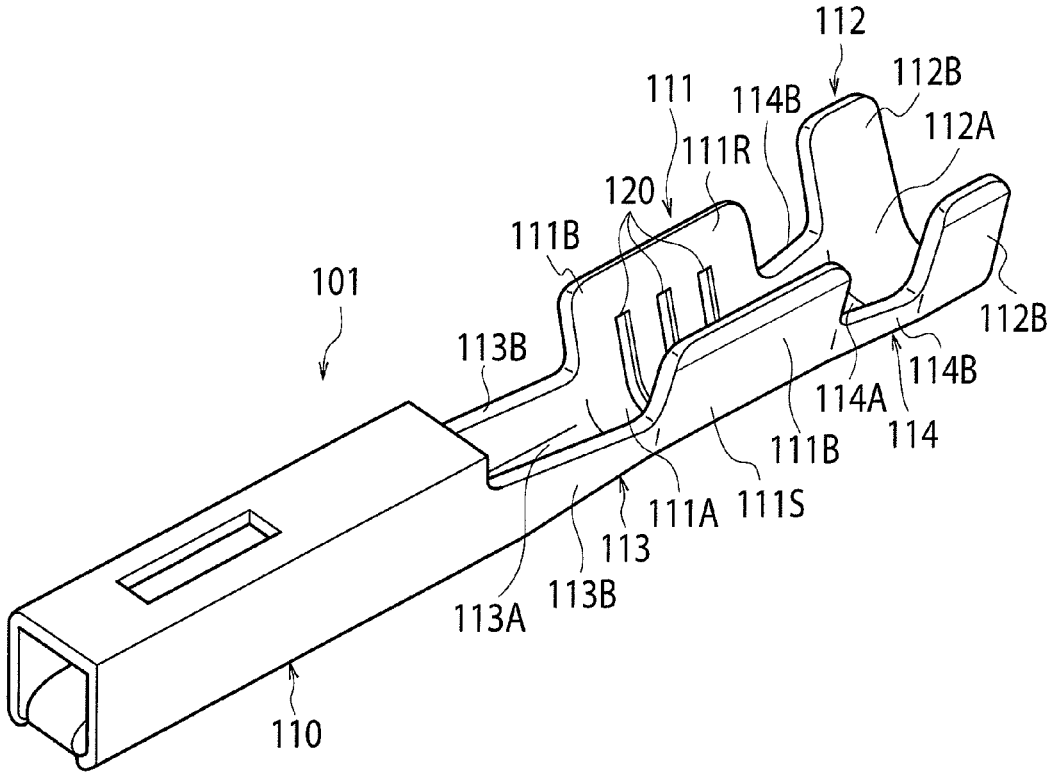
FIG. 1 is a perspective view showing a structure of an associated crimp terminal.
Figure 2:
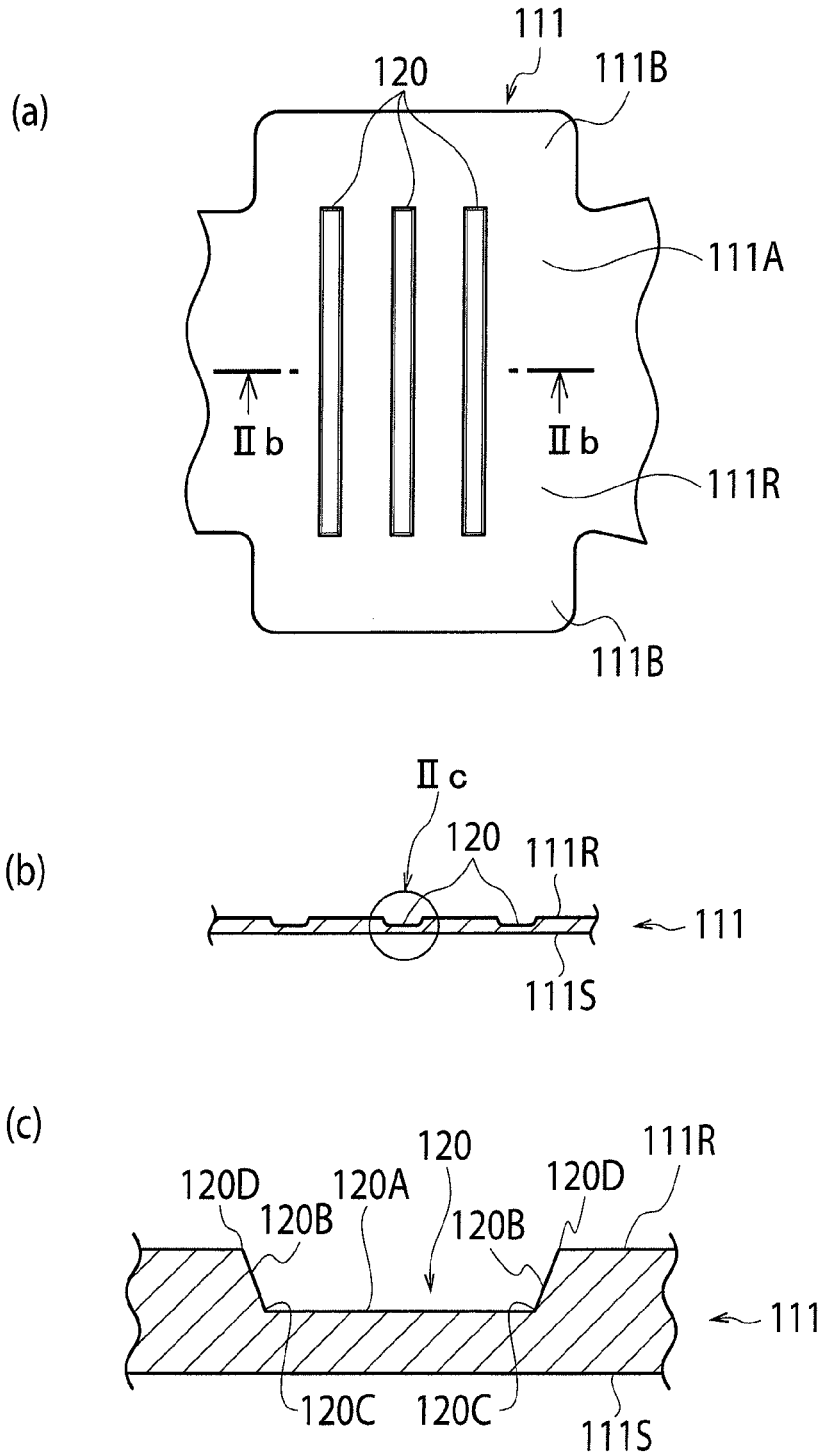
FIG. 2 shows a state before a conductor crimp portion of the crimp terminal in FIG. 1 is crimped, where (a) is a developed plan view, (b) is a cross sectional view taken along the line IIb-IIb in (a), and (c) is an enlarged view of a portion IIc in (b).
Figure 3:
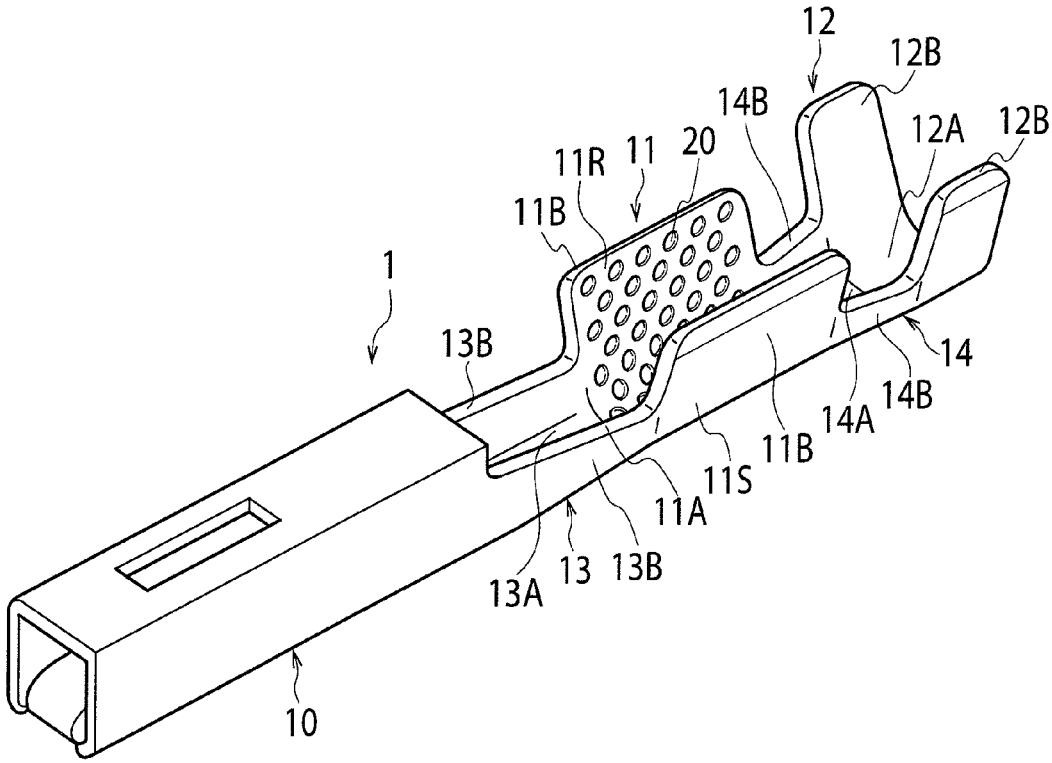
FIG. 3 is a perspective view showing a structure of a crimp terminal according to one embodiment of the present invention.
Figure 4:
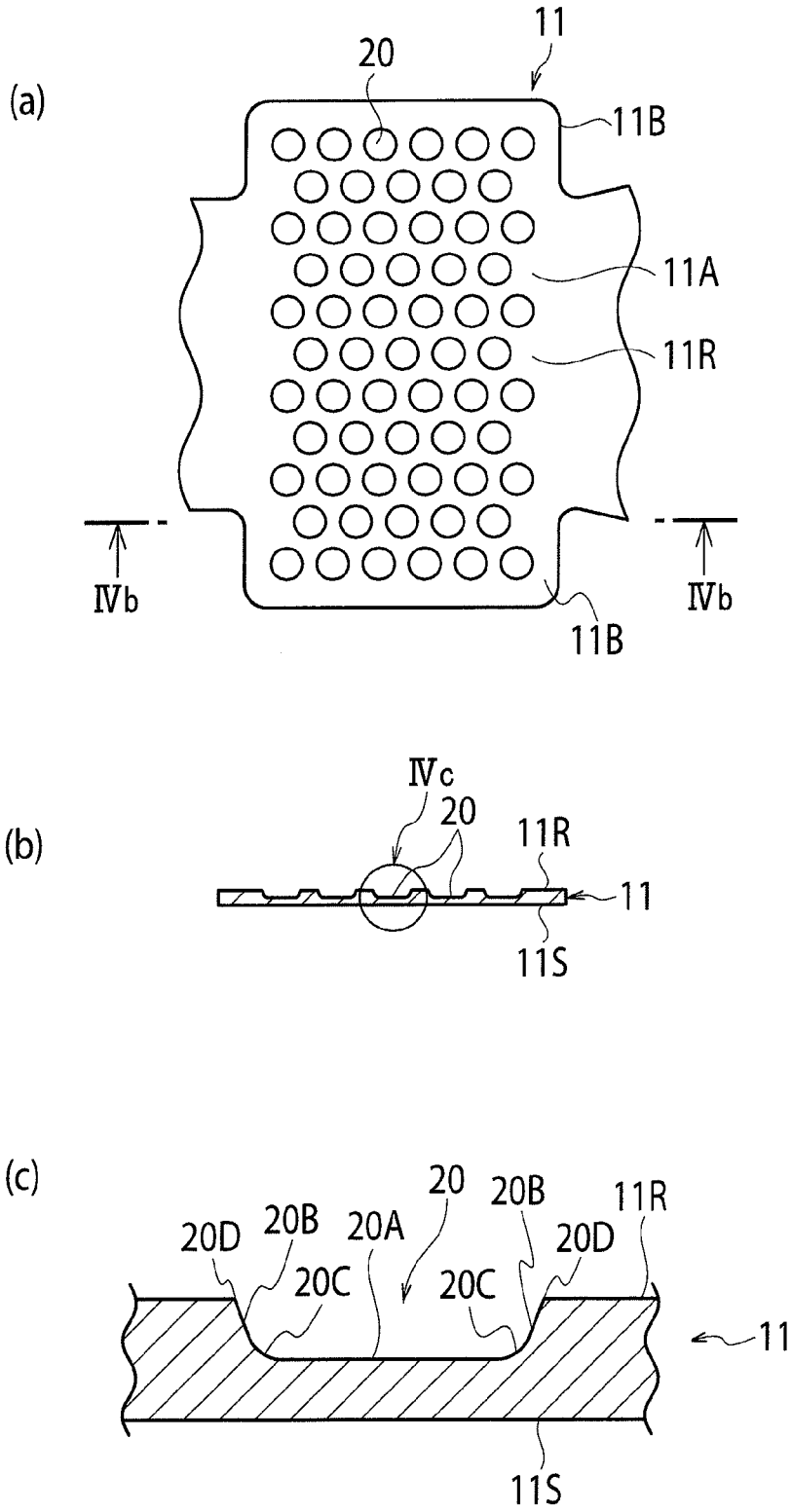
FIG. 4 shows a state before a conductor crimp portion of the crimp terminal in FIG. 3 is crimped, where (a) is a developed plan view, (b) is a cross sectional view taken along the line IVb-IVb in (a), and (c) is an enlarged view of a portion IVc in (b).

FIG. 3 is a perspective view showing a structure of a crimp terminal according to the embodiment. FIG. 4 shows a state before a conductor crimp portion of the crimp terminal is crimped, where FIG. 4(*a*) is a developed plan view, FIG. 4(*b*)

is a cross sectional view taken along the line IVb-IVb in FIG. 4(*a*), and FIG. 4(*c*) is an enlarged view of a portion IVc in FIG. 4(*b*).

As shown in FIG. 3, a crimp terminal 1 is one of a female type and has such a structure as that, in the front portion in the longitudinal direction (also the longitudinal direction of a conductor of an electric wire to be connected, that is, a direction in which the electric wire extends) of the terminal, there is provided a box-type electrical connection portion 10 to be connected to a male terminal on a mating connector side, behind the electrical connection portion 10, there is provided a conductor crimp portion 11 to be crimped to an exposed conductor Wa (refer to FIG. 4) of an end of an electric wire (not shown), and still behind the conductor crimp portion 11, there is provided a coated crimping portion 12 to be crimped to the electric wire's portion coated with an insulative coating. Between the electrical connection portion 10 and the conductor crimp portion 11, there is provided a first connecting portion 13 for connecting the electrical connection portion 10 with the conductor crimp portion 11. Between the conductor crimp portion 11 and the coated crimping portion 12, there is provided a second connecting portion 14 for connecting the conductor crimp portion 11 with the coated crimping portion 12.

The conductor crimp portion 11, which has a bottom plate 11A and a pair of conductor crimping pieces 11B, 11B provided to extend upwardly from right and left side edges of the bottom plate 11A and to be so crimped as to wrap the conductor of the electric wire positioned on an inner surface of the bottom plate 11A, is formed substantially into a U-shape in cross section. The coated crimping portion 12, which has a bottom plate 12A and a pair of coated crimping pieces 12B, 12B provided to extend upwardly from right and left side edges of the bottom plate 12A and so crimped as to wrap an electric wire (a portion with an insulative coating) positioned on an inner surface of the bottom plate 12A, is formed substantially into a U-shape in cross section.

The first connecting portion 13 on the front side of the conductor crimp portion 11 and the second connecting portion 14 on the rear side of the conductor crimp portion 11, which respectively have bottom plates 13A, 14A and low side plates 13B, 14B standing upwardly from right and left side edges of the bottom plates 13A, 14A, are each formed substantially into a U-shape in cross section.

A bottom plate in a range from a bottom plate (not shown) of the electrical connection portion 10 in the front portion to the coated crimping portion 12 in the rearmost portion (the bottom plate 13A of the first connecting portion 13, the bottom plate 11A of the conductor crimp portion 11, the bottom plate 14A of the second connecting portion 14, and the bottom plate 12A of the coated crimping portion 12) is formed continuously in a form of one piece of band plate. The front and rear ends of the low side plate 13B of the first connecting portion 13 are continuous with respective lower half portions at a rear end of a side plate (no reference numeral) of the electrical connection portion 10 and at a front end of the conductor crimping piece 11B of the conductor crimp portion 11, while the front and rear ends of the low side plate 14B of the second connecting portion 14 are continuous with respective lower half portions at a rear end of the conductor crimping piece 11B of the conductor crimp portion 11 and at a front end of the coated crimping piece 12B of the coated crimping portion 12.

With the conductor crimp portion 11 in a state before being crimped to the conductor of the electric wire, on an inner surface 11R (of the inner surface 11R and an outer surface 11S of the conductor crimp portion 11) on a side contacting the conductor of the electric wire, many small circular recesses 20, as recess-shaped serrations, are so provided as to be scattered about in a zigzag form, in a state of being spaced apart from each other.

As shown in FIG. 4(*b*) and FIG. 4(*c*), each of the small circular recesses 20 has a cross section which is either rectangular or inverted trapezoidal, where an inner bottom surface 20A of the recess 20 is so formed as to be substantially parallel to the outer surface 11S of the conductor crimp portion 11. An inner periphery corner portion where an inner periphery side surface 20B and the inner bottom surface 20A of the recess 20 intersect with each other is provided with a roundness portion 20C for connecting the inner bottom surface 20A with the inner periphery side surface 20B by a smooth continuous curved surface.

The serration of the conductor crimp portion 11 is prepared by a press machining of the conductor crimp portion 11 with a metal mold having many small cylindrical protrusion portions corresponding to the recesses 20. A roundness portion 20C of the inner periphery corner portion of the recess 20 can be machined by having added a roundness portion to a distal end peripheral edge of each of the cylindrical protrusion portions of the metal mold.

As a first method of making the press metal mold, a discharge machining is conceivable. In this case, as an electrode, firstly, circular recesses for making the cylindrical protrusion portions of the metal mold are machined with a drill. Then, by using the electrode having many recesses machined with the drill, the discharge machining is implemented, to thereby make the press metal mold having cylindrical protrusion portions. In this case, due to the characteristic of the discharge machining, the roundness portion is naturally formed at the distal end peripheral edge of the protrusion portion of the metal mold. Thus, transferring the roundness portion to a terminal material by the press can machine the roundness portion 20C at the inner peripheral corner portion of the recess 20 of the serration of the terminal.

As a second method, forming protrusion portions by mating many cylindrical pins into a block is conceivable. In this case, firstly, a hole is opened in the block with the drill, to thereby embed a lower half portion of the pin in each of the holes. Then, an upper half portion of each of the pins protruding forms the metal mold having many protrusion portions. In this case, the roundness portion is to have been added to the distal end peripheral edge of each of the pins. Thus, transferring the roundness portion to the terminal material by the press can machine the roundness portion 20C at the inner peripheral corner portion of the recess 20 of the serration of the terminal.

For crimping the conductor crimp portion 11 of the crimp terminal 1 to the conductor of the end of the electric wire, the crimp terminal 1 is placed on a placing surface (upper surface) of a not-shown lower mold (anvil), then the conductor of the end of the electric wire is inserted between the conductor crimping pieces 11A of the conductor crimp portion 11, and then the conductor of the end of the electric wire is placed on the upper surface of the bottom plate 11A. Then, lowering the upper mold (crimper) relative to the lower mold allows a guide inclined surface of the upper mold to gradually bring down a distal end side of the conductor crimping piece 11B inwardly.

Then, with the upper mold (crimper) further lowered relative to the lower mold, finally, the distal end of the conductor crimping piece 11B is so rounded, with a curved surface continuous from the guide inclined surface to a central mountainous portion of the upper mold, as to be folded back to the conductor side, and the distal ends of the conductor crimping pieces 11B being frictionally mated with each other are made to eat into the conductor, to thereby crimp the conductor crimping piece 11B in such a manner as to wrap the conductor.

The above operations can connect, by the crimping, the conductor crimp portion 11 of the crimp terminal 1 to the conductor of the electric wire. With respect to the coated crimping portion 12 as well, the lower mold and the upper mold are used to gradually bend the coated crimping pieces 12B inwardly, to thereby crimp the coated crimping pieces 12B to the electric wire's portion coated with the insulative coating. By these operations, the crimp terminal 1 can be electrically and mechanically connected to the electric wire.

In the crimp operation by the crimping, an applied pressure force allows the conductor of the electric wire to enter into the small circular recess 20 as the serration at the inner surface of the conductor crimp portion 11 while causing a plastic deformation, thus strengthening the joint between the crimp terminal 1 and the electric wire.

Figure 5:
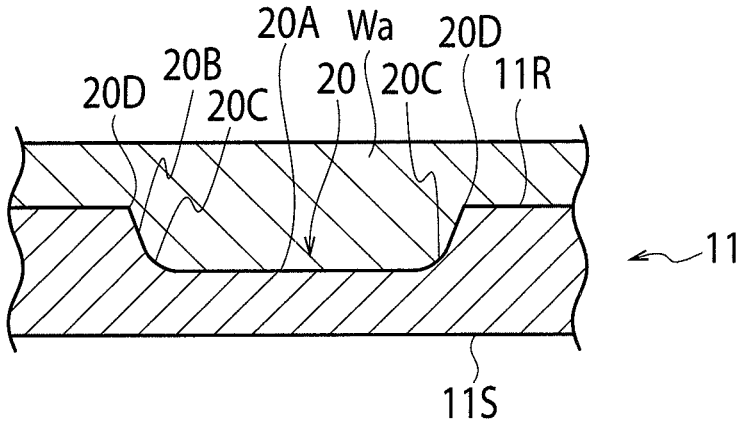
FIG. 5 shows a state in which a conductor after being crimped enters into a recess-shape serration, where (a) is an enlarged cross sectional view showing the conductor entering into the serration (small circular recess) in FIG. 4 and (b) is an enlarged cross sectional view showing the conductor entering into the serration of the associated crimp terminal as a comparative example.
Figure 5:
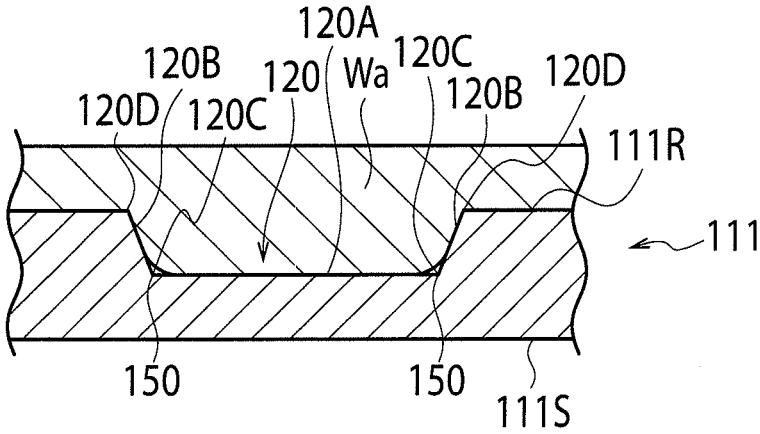

In this case, as shown in FIG. 5(*a*), the surface of the conductor Wa caused to flow by the pressing force has a frictional mating with the hole edge 20D of each of the recesses 20 or the surface of the conductor Wa entering into the recess 20 causes a frictional mating with the inner periphery side surface 20B of the recess 20, thereby an oxide film of the surface of the conductor Wa is peeled off and a newly formed surface exposed has a contact conduction with the terminal.

In this respect, in the crimp terminal 1, since many small circular recesses 20 are provided as the serrations, a total length of the hole edge 20D of the recess 20 brings about an effectiveness in scraping off the oxide film, irrespective of the extending direction of the conductor Wa. Thus, the contact conduction effect by the exposure of the newly formed surface can be more increased than when the linear serration 120 intersecting with the direction in which the conductor Wa of the electric wire extends is provided like the associated example in FIG. 5(*b*).

Since the inner periphery corner portion where the inner bottom surface 20A and inner periphery side surface 20B of the small circular recess 20 intersect with each other has the roundness portion 20C in a form of a smooth curved surface, the conductor Wa having entered into the recess 20 is allowed to smoothly flow along the roundness portion 20C, thus enabling to reduce the gap caused to the inner periphery corner portion. It was so feared that, in the case of a large gap, being influenced by the thermal shock, mechanical vibration or the like, the oxide film grows with the gap as a start point to thereby lower the contact conductivity between the conductor and the terminal. However, capability of reducing the gap can suppress the growth of the oxide film, thus enabling to maintain a good contact conduction performance for a long time.

According to the above embodiment, the crimp terminal 1 is defined as a female terminal metal fitting having the box-type electrical connection portion 10. However, not limited to female, the crimp terminal 1 may be a male terminal metal fitting having a male tab or what is called an LA terminal with a through hole formed at a metallic plate material. That is, according to necessity, the crimp terminal may be one having an arbitrary configuration.

As set forth above, the embodiment of the present invention has been explained. However, the present invention is not limited to the above embodiment and therefore various modifications are allowed.

The invention claimed is:

1. A crimp terminal comprising:

an electrical connection portion provided in a front portion in a longitudinal direction of the terminal; and a conductor crimp portion provided behind the electrical connection portion and crimped and connected to a conductor of an end of an electric wire, the conductor crimp portion having a cross section formed into a U-shape by a bottom plate and a pair of conductor crimping pieces provided to extend upwardly from both right and left side edges of the bottom plate and crimped to wrap the conductor disposed on an inner surface of the bottom plate, wherein the conductor crimp portion before being crimped to the conductor of the end of the electric wire includes, in an inner surface of the conductor crimp portion, circular recesses as serrations scattered to be spaced from each other, and wherein at an inner periphery corner portion where an inner bottom surface and an inner periphery side surface of each of the recesses intersect with each other, each of the recesses has a roundness portion for connecting the inner bottom surface with the inner periphery side surface by a smooth continuous curved surface.

* * * * *